US005715708A

United States Patent [19]

Park

[11] Patent Number: 5,715,708

[45] Date of Patent: Feb. 10, 1998

[54] WASHING MACHINE EQUIPPED WITH A WASHING TUB OF A MULTIPLE-STAIRSTEP SHAPE

[75] Inventor: Kwan-Choul Park, Seoul, Rep. of Korea

[73] Assignee: Daewoo Electronics Co., Ltd., Seoul, Rep. of Korea

[21] Appl. No.: 758,938

[22] Filed: Dec. 3, 1996

[30] Foreign Application Priority Data

Dec. 28, 1995 [KR] Rep. of Korea ..... U.M. 95-50776

[51] Int. Cl.[6] ..... D06F 37/12

[52] U.S. Cl. ..... 68/53; 68/23.6

[58] Field of Search ..... 68/23 R, 23.6, 68/23.7, 53, 131, 133

[56] References Cited

U.S. PATENT DOCUMENTS

| | | | |
|---|---|---|---|
| 3,233,436 | 2/1966 | Gibson | 68/23.6 |
| 4,584,732 | 4/1986 | Kohsaka | 68/23 R X |
| 5,509,283 | 4/1996 | Lee et al. | 68/53 X |

FOREIGN PATENT DOCUMENTS

| | | | |
|---|---|---|---|
| 860633 | 12/1952 | Germany | 68/23.6 |
| 52-55264 | 5/1977 | Japan | 68/23 R |
| 2269396 | 2/1994 | United Kingdom . | |

*Primary Examiner*—Philip R. Coe

*Attorney, Agent, or Firm*—Beveridge, DeGrandi, Weilacher & Young, LLP

[57] ABSTRACT

A washing machine is disclosed which is equipped with a washing tub having a plurality of cylindrical side walls. The washing machine has a pulsator reception part, a washing tub body and a plurality of annular flat bases. The pulsator reception part has an opening in the bottom center portion thereof and rotatably receives the pulsator. The washing tub body is formed on the pulsator reception part and has a plurality of cylindrical side walls which are progressively reduced in diameters from the lower portion to the upper portion thereof. The plurality of annular flat bases each have a plurality of holes and connect the lower end of one of the plurality of cylindrical side walls with the upper end of another one of the plurality of cylindrical side walls.

4 Claims, 4 Drawing Sheets

WASHING MACHINE EQUIPPED WITH A WASHING TUB OF A MULTIPLE-STAIRSTEP SHAPE

BACKGROUND OF THE INVENTION

1. Field of the Invention

The present invention relates to a washing machine, more particularly to a washing machine equipped with a washing tub of a multiple stairstep shape.

2. Prior Art

In general, commercial washing machines are classified into a pulsator-type washing machine, a drum-type washing machine and an agitator-type washing machine by a washing manner.

The pulsator-type washing machine has a pulsator rotatably mounted on the bottom of the washing tub therein. When the pulsator is rotated, the washing water in the washing tub is also rotated. The rotation of the washing water causes a whirlpool-type waterflow in the washing water. The pulsator-type washing machine is one that rotates laundry together with the washing water and is most widely used.

The drum-type washing machine has a cylindrical drum having a plurality of holes thereon. The cylindrical drum is rotatably mounted in the reservoir. A plurality of protrusions are formed on the inside of the cylindrical drum. When the cylindrical drum is rotated, the laundry is lifted up by means of the plurality of protrusions. The laundry which has been lifted up falls down by means of gravity. With the laundry lifted up and fallen down, the laundry is washed. The drum-type washing machine is suitable for a greater amount of laundry to be washed at one time.

An agitator-type washing machine has an agitator rotatably mounted on the center portion of the washing machine. A plurality of wings are formed on the periphery of the agitator. When the agitator is rotated, the plurality of wings agitate washing water in the washing tub. The agitation of the washing water causes a certain waterflow to be formed in the washing water. The waterflow agitates the laundry in the washing water. The agitated laundry strikes the agitator and the wall of the washing tub. The striking enables the agitated laundry to be washed.

FIG. 1 is a view for schematically showing a conventional pulsator-type washing machine, and FIG. 2 is a view for schematically showing the washing tub of FIG. 1. As shown in FIGS. 1 and 2, the conventional pulsator-type washing machine includes a reservoir 1, a washing tub 2, and a pulsator 3. The reservoir 1 is a container which accommodates washing water. The washing tub 2 is mounted in the reservoir 1. The pulsator 3 is rotatably mounted in the inner bottom of the washing tub 2. The pulsator-type washing machine is equipped with an electric motor 4, a speed-reducing gear assembly 5, and a pulley belt 8. The electric motor 4 generates a rotational force. The rotational force is transmitted to the speed-reducing gear assembly 5 through the pulley belt 8. The pulsator 3 is fixedly mounted on the speed-reducing gear assembly 5. Accordingly, the activation of the electric motor 4 causes the pulsator 3 to be rotated. The speed-reducing gear assembly 5 reduces a rotational speed of the electric motor 4. With the reduced rotational speed of the speed-reducing gear assembly 5 used, a washing step, a rinsing step, and a dehydrating step for the laundry proceeds either in a selective manner or in a sequential manner. The waterflow caused by the rotation of the pulsator 3 is a heart-type waterflow. Since the heart-type waterflow is concentric waterflow, laundry in the waterflow becomes twisted and entangled. Therefore, since detergent and washing water do not fully penetrate between articles of the laundry, the washing of the laundry is not performed adequately. Further, greater friction between the pulsator 3 and the laundry causes damage to thin and delicate articles of the laundry.

SUMMARY OF THE INVENTION

It is an object of the present invention to provide a washing machine, more particularly to a washing machine equipped with a washing tub of a multiple-stairstep shape.

In order to achieve the object, the washing tub of a multiple-stairstep shape includes a pulsator reception part, a washing tub body, and a plurality of annular flat bases. The pulsator reception part has an opening in the center portion of the bottom and rotatably accommodates the pulsator. The washing tub body is formed on the upper portion of the pulsator reception part and has a plurality of cylindrical side walls which are progressively reduced in their diameters from the lower end to the upper end of the washing tub body. Each of the plurality of flat bases is formed in an annular manner, has a plurality of holes, and connects the periphery of the lower end of one cylindrical side wall with the periphery of the upper end of another cylindrical side wall along the peripheries of both the lower and upper ends. The upper end portion of the uppermost cylindrical side wall has a protrusion inwardly protruded along its periphery. The plurality of holes are spaced apart from each other at a certain distance.

Washing water is rotated in the multiple-stairstep-shaped washing tub in accordance with the pulsator. The rotation of the washing water generates a centrifugal force in the washing water. The washing water moves toward the plurality of cylindrical side walls by the centrifugal force. The washing water which has moved toward the side walls rises up along each of the side walls so as to form a first waterflow. Some of the first waterflow returns back toward the center portion or the lower portion of the washing tub, and another portion of the first waterflow moves along the bottom of each of the plurality of the flat bases so as to form a second waterflow. The second waterflow is a small waterflow formed in the washing water. Further, some washing water rises up outside the multiple-stairstep-shaped washing tub through the plurality of holes formed in the plurality of flat bases to thereby form an external waterflow. The external waterflow returns into the washing tub through the other plurality of holes formed in upper plurality of flat bases so as to form a first external waterflow. The first external waterflow interrupts the first waterflow to form a composite waterflow in the washing tub. The composite waterflow prevents laundry from being twisted or tangling so that washing effect of the laundry can be enhanced.

BRIEF DESCRIPTION OF THE DRAWINGS

The above objects, and other features and advantages of the present invention will become apparent from the following description taken in conjunction with one embodiment thereof with reference to the accompanying drawings, in which.

DETAILED DESCRIPTION OF THE PREFERRED EMBODIMENT

Referring to the accompanying drawings, the embodiment of the present invention will be described in detail hereinafter.

Figure 1:
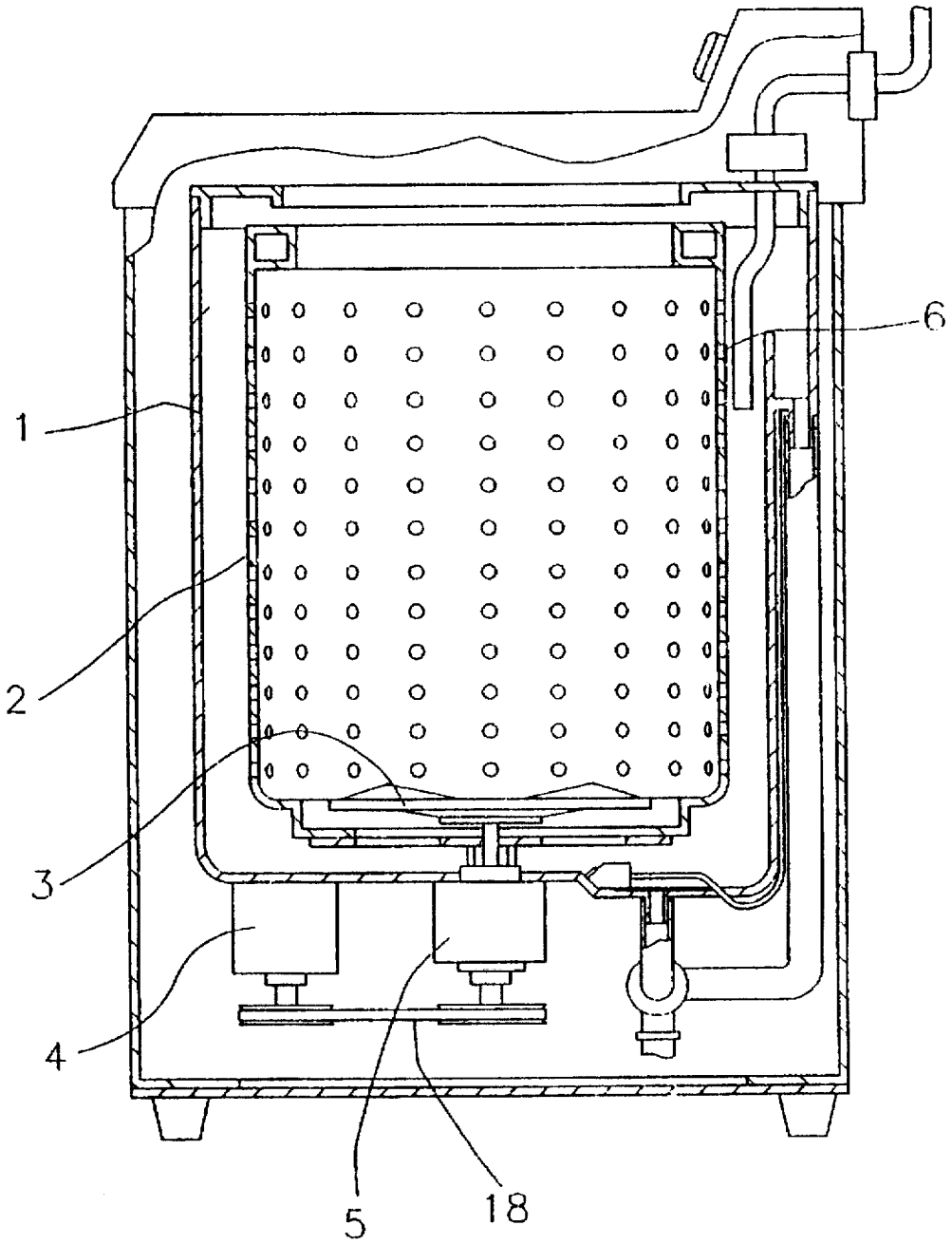
FIG. 1 PRIOR ART
FIG. 1 is a view for schematically showing a conventional pulsator-type washing machine.
Figure 2:
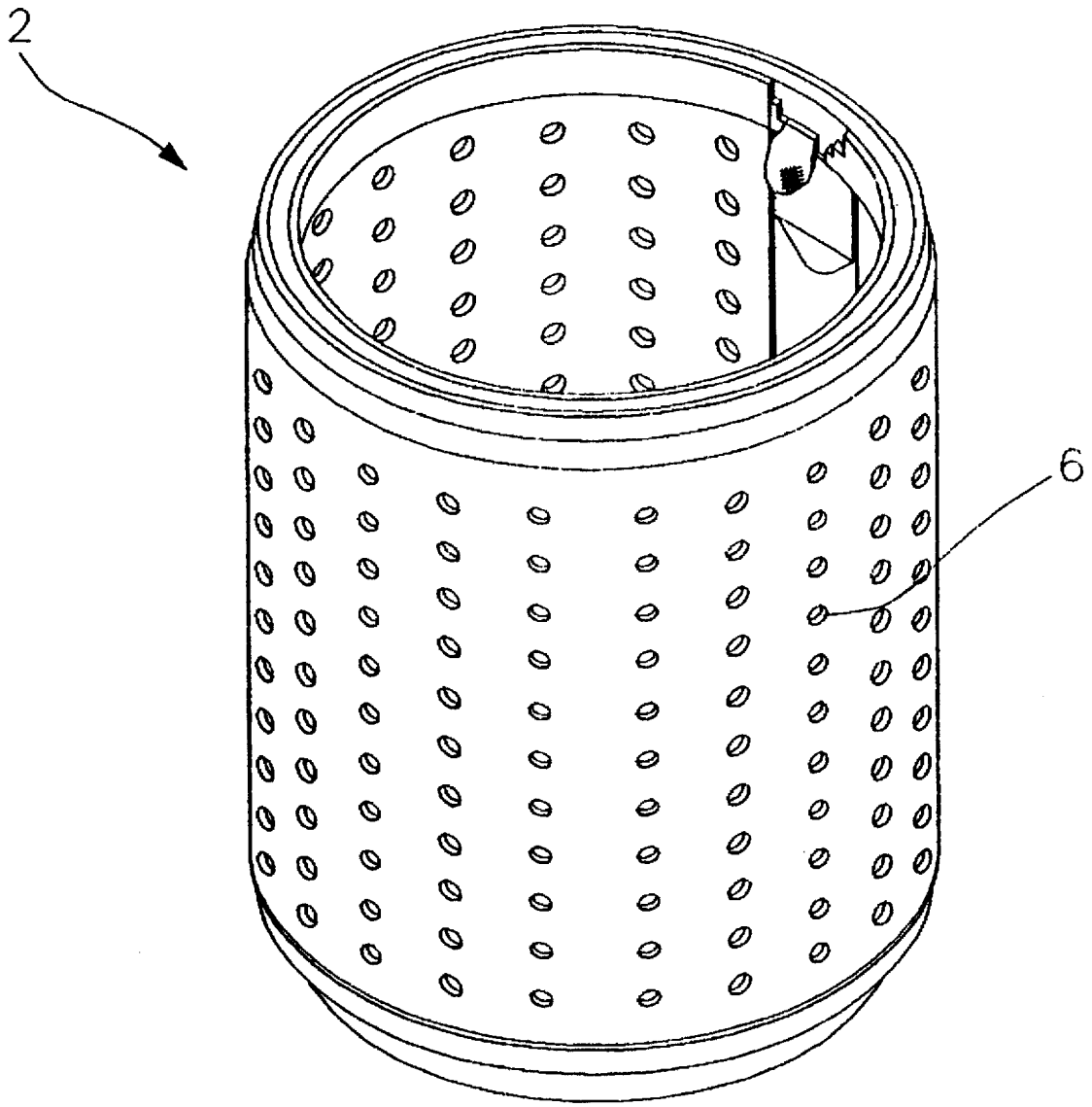
FIG. 2 PRIOR ART
FIG. 2 is a view for schematically showing the washing tub of FIG. 1.
Figure 3:
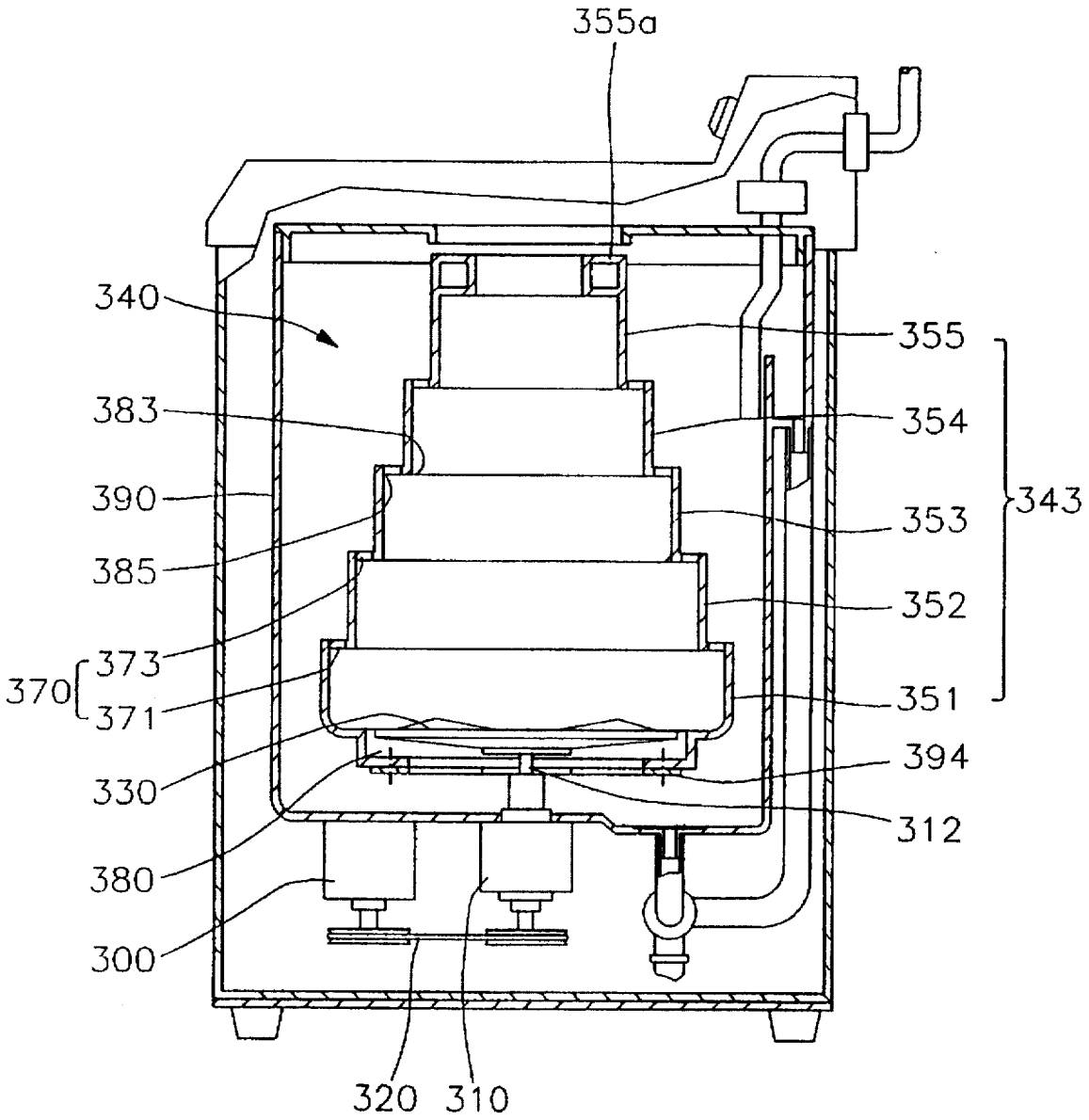
FIG. 3 is a view for schematically showing a pulsator-type washing machine equipped with a washing tub of a multiple-stairstep shape according to one embodiment of the present invention.
Figure 4:
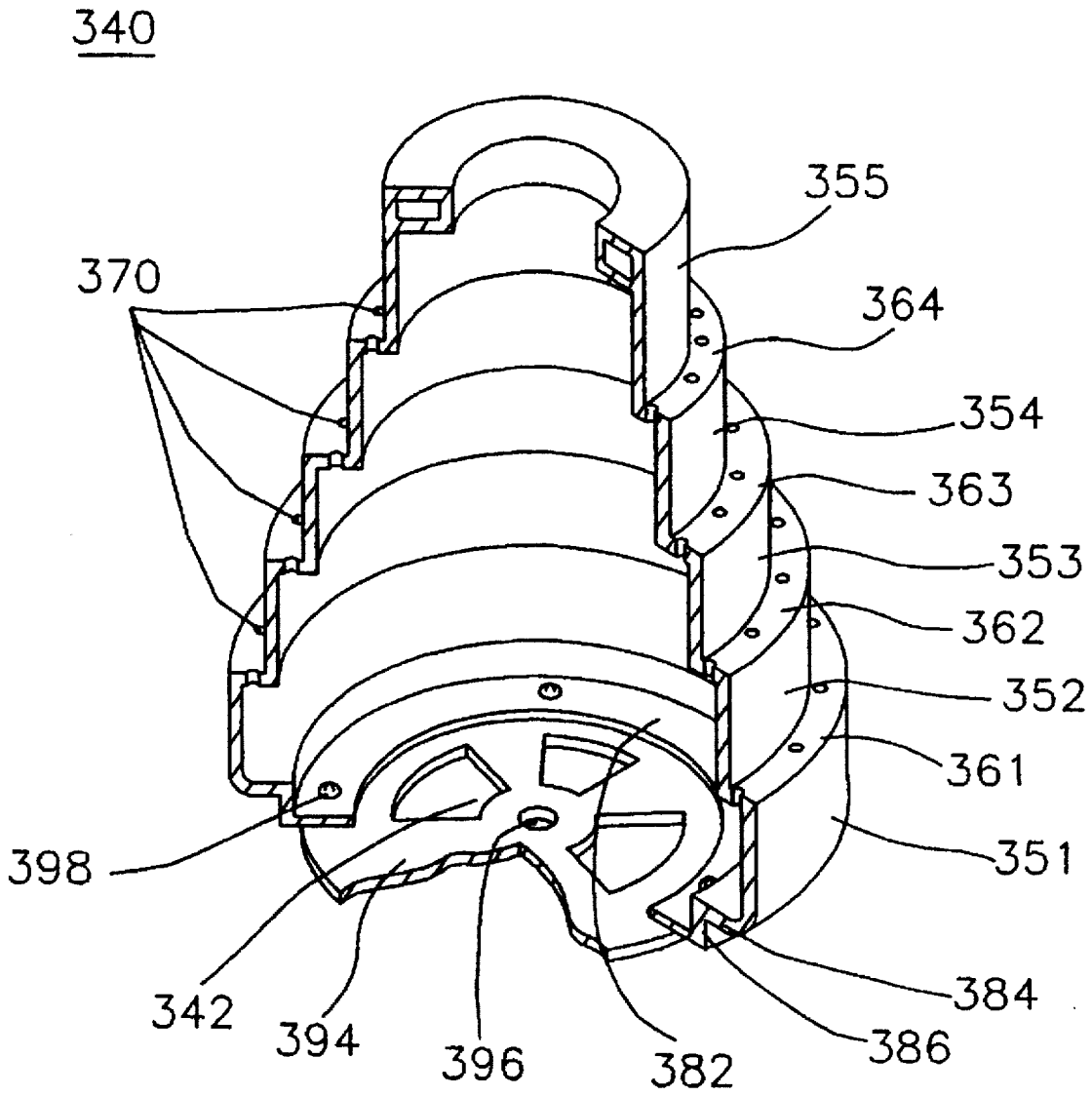
FIG. 4 is a view for schematically showing the washing tub of FIG. 3.

FIG. 3 is a view for schematically showing a pulsator-type washing machine equipped with a washing tub of a multiple-stairstep shape according to one embodiment of the present invention, and FIG. 4 is a view for schematically showing the washing tub of FIG. 3. As shown in FIGS. 3 and 4, the washing machine equipped with the washing tub of a multiple-stairstep shape according to the embodiment of the present invention comprises an electric motor 300, a speed-reducing gear assembly 310, a pulley belt 320, a pulsator 330, a multiple-stairstep-shaped washing tub 340 and a reservoir 390. The electric motor 300 provides a motive power when electric power is supplied from the external. The speed-reducing gear assembly 310 is for reducing a rotational speed of the electric motor 300. The pulley belt 320 connects the electric motor 300 with the speed-reducing gear assembly 310 to transmit the motive power to the speed-reducing gear assembly 310. The center portion of the pulsator 330 is fixed to the shaft of the speed-reducing gear assembly 310. Therefore, the pulsator 330 is rotated according to the rotation of the speed-reducing gear assembly 310. The reservoir 390 is a container for accommodating washing water. The shaft 312 of the speed-reducing gear assembly 310 is protruded into the reservoir 390 through the bottom plate of the reservoir 390. The pulsator 330 is placed in the reservoir 390 and in parallel with the bottom plate. The multiple-stairstep-shaped washing tub 340 is mounted in the reservoir 390. An opening 342 is formed in the bottom center portion of the multiple-stairstep-shaped washing tub 340. The pulsator 330 is rotatably inserted into the multiple-stairstep-shaped washing tub through the opening 342. Therefore, washing water in the multiple-stairstep-shaped washing tub 340 in the reservoir 390 is rotated according to the rotation of the pulsator 330. The multiple-stairstep-shaped washing tub 340 has a plurality of cylindrical side walls which have different diameters. The diameters are progessively reduced from the lowermost portion to the uppermost portion of the multiple-stairstep-shaped washing tub 340. That is, the side wall of the multiple-stairstep-shaped washing tub 340 has a plurality of cylindrical side walls which have different diameters from one another. In FIGS. 3 and 4, the multiple-stairstep-shaped washing tub 340 has 5 cylindrical side walls. Reference numerals 351, 352, 353, 354 and 355 denote a first cylindrical side wall, a second cylindrical side wall, a third cylindrical side wall, a fourth cylindrical side wall and a fifth cylindrical side wall, respectively. The first to fifth cylindrical side walls 351, 352, 353, 354 and 355 form a multiple-stairstep-shaped washing tub body 343. The first cylindrical side wall 351 is the lowermost portion of the multiple-stairstep-shaped washing tub 340 and the fifth cylindrical side wall takes the uppermost portion of the multiple-stairstep-shaped washing tub 340. A first skirt 384 is inwardly protruded along the periphery of the lower end of the first cylindrical side wall 351. The upper end portion of the fifth cylindrical side wall 355 has a protrusion 355*a* inwardly protruded along the periphery of the upper end portion. Further, as shown in FIGS. 3 and 4, the first cylindrical side wall 351 has the largest diameter, and the fifth cylindrical side wall 355 has the smallest diameter. An annular flat base connects the lower end of one cylindrical side wall with the upper end of another cylindrical side wall. Reference numerals 361, 362, 363, 364 and 365 denote a first annular flat base, a second annular flat base, a third annular flat base, a fourth annular flat base, and a fifth annular flat base. The connection of one annular flat base with two cylindrical side walls, as shown in FIG. 3, forms two angular portions, that is, a first angular portion 383 and a second angular portion 385. The first angular portion 383 is formed at the connection of an annular flat base with one cylindrical side wall having a larger diameter, and the second angular portion 385 is formed at the connection of the annular flat base with another cylindrical side wall having a smaller diameter. Each of the first to the fourth annular flat bases 361, 362, 363, and 364 has a plurality of holes 370 spaced apart at a certain distance. The first cylindrical side wall 351 has a pulsator reception part 380, which is formed on the lower portion of the first cylindrical side wall 351, so as to accommodate the pulsator 330 which is inserted through the opening 342. The pulsator reception part 380 has a bottom plate 382 and a first skirt 384. The center portion of the bottom plate 382 has the opening 342. A second skirt 386 is upwardly protruded along the periphery of the bottom plate 382. The second skirt 386 is connected with the first skirt 384. The connection of the first and the second skirt 384 and 386 is shown in FIG. 4. The bottom plate 382 is supported by a washing tub supporter 394. A center hole 396 is formed in the center portion of the washing tub supporter 394. The shaft 312 of the speed-reducing gear assembly 310 is inserted into the center hole 396. The washing tub supporter 394 is engaged with the bottom plate 382 through a plurality of engagement parts 398. The multiple-stairstep-shaped washing tub 340 is mounted in the reservoir 390 through the insertion of the shaft 312, the engagement, and the support of the speed-reducing gear assembly 310.

Operations of the washing machine equipped with the multiple-stairstep-shaped washing tub according to the embodiment of the present invention will be described in detail hereinafter.

With electric power supplied to the electric motor 300, the electric motor 300 is rotated to generate a driving force having a certain rotational speed. The driving force is transmitted together with the rotational speed to the speed-reducing assembly 310 through the pulley belt 320. The transmitted rotational speed is reduced to an appropriate rotational speed by the speed-reducing gear assembly 310, so that the shaft 312 of the speed-reducing gear assembly 310 is rotated at the reduced rotational speed. The pulsator 330 is rotated according to the rotation of the shaft 312, to thereby rotate washing water in the multiple-stairstep-shaped washing tub 340 in the reservoir 390. The washing water moves, while being rotated, toward the plurality of cylindrical side walls, that is, the first to the fifth cylindrical side walls 351, 352, 353, 354, and 355 in this embodiment, by a centrifugal force generated in the washing water from the rotation of the pulsator 330. The moving washing water rises up along the respective side walls 351, 352, 353, 354, and 355 to form a first waterflow. The first waterflow strikes the first angular portion 383. Some of the first waterflow which strikes the first angular portion 383 returns back toward the center portion or the lower portion of the multiple-stairstep-shaped washing tub 340, and some of the first waterflow moves along the bottom of the second angular portion 385 so as to form a second waterflow. The second waterflow is a small waterflow formed in the washing water 340. The small second waterflow interrupts the waterflow formed in the washing water by the pulsator 330.

Further, some washing water rises up outside the multiple-stairstep-shaped washing tub 340 through the plurality of holes formed in the plurality of flat bases to thereby form an external waterflow. The external waterflow returns into the washing tub 340 through the other plurality of holse formed in upper plurality of flat bases so as to form a first external waterflow. The first external waterflow interrupts the first waterflow to form a composite waterflow in the washing tub 340. The composite waterflow prevents laundry from twisting and tangling so that washing effect of the laundry can be enhanced.

While the present invention has been particularly shown and described with reference to one preferred embodiment, it will be understood by those skilled in the art that various changes in form and details may be effected therein without departing from the spirit and scope of the invention as defined by the appended claims.

What is claimed is:

1. A washing machine for washing laundry with washing water in a washing tub rotated by a pulsator, comprising:

a pulsator reception part having an opening in the bottom center portion thereof and for rotatably receiving the pulsator;

a washing tub body formed on the pulsator reception part and having a plurality of cylindrical side walls which are progressively reduced in diameters from the lower portion to the upper portion thereof; and a plurality of annular flat bases each having a plurality of holes and connecting the lower end of one of the plurality of cylindrical side walls with the upper end of another one of the plurality of cylindrical side walls.

2. The washing machine as claimed in claim 1, wherein the upper end portion of the uppermost cylindrical side wall of the plurality of cylindrical side walls has a protrusion inwardly protruded along the periphery of the upper end portion.

3. The washing machine as claimed in claim 1, wherein the plurality of cylindrical side walls are 5.

4. The washing machine as claimed in claim 1, wherein the plurality of holes are spaced apart at a certain distance.

* * * * *